US006852176B2

(12) United States Patent
Wu et al.

(10) Patent No.: US 6,852,176 B2
(45) Date of Patent: Feb. 8, 2005

(54) WEAR-RESISTANT, CORROSION-RESISTANT COBALT-BASED ALLOYS

(75) Inventors: James B. C. Wu, St. Louis, MO (US); Matthew X. Yao, Belleville (CA)

(73) Assignee: Deloro Stellite Holdings Corporation, St. Louis, MO (US)

( * ) Notice: Subject to any disclaimer, the term of this patent is extended or adjusted under 35 U.S.C. 154(b) by 174 days.

(21) Appl. No.: 10/250,205

(22) Filed: Jun. 12, 2003

(65) Prior Publication Data

US 2004/0057863 A1 Mar. 25, 2004

Related U.S. Application Data

(63) Continuation-in-part of application No. 10/356,952, filed on Feb. 3, 2003, now abandoned.

(60) Provisional application No. 60/396,524, filed on Jul. 17, 2002.

(51) Int. Cl.[7] ..... C22C 19/07

(52) U.S. Cl. ..... 148/425; 148/442; 420/436; 420/437; 420/438; 420/439; 420/440; 420/588

(58) Field of Search ..... 420/436, 437, 420/438, 439, 588; 148/425, 442

(56) References Cited

U.S. PATENT DOCUMENTS

| | | | | |
|---|---|---|---|---|
| 3,180,012 A | | 4/1965 | Smith | |
| 3,257,178 A | | 6/1966 | Severns, Jr. et al. | |
| 3,331,700 A | | 7/1967 | Severns, Jr. et al. | |
| 3,361,560 A | | 1/1968 | Severns, Jr. et al. | |
| 3,410,732 A | | 11/1968 | Smith | |
| 3,795,430 A | | 3/1974 | Farley | |
| 3,839,024 A | | 10/1974 | Demo, Jr. et al. | |
| 4,465,515 A | | 8/1984 | Mundorff | |
| 4,665,996 A | | 5/1987 | Foroulis et al. | |
| 4,692,305 A | * | 9/1987 | Rangaswamy et al. | 420/436 |
| 5,649,994 A | | 7/1997 | Holko | |
| 6,066,191 A | | 5/2000 | Tanaka et al. | |
| 6,479,014 B1 | * | 11/2002 | Wu et al. | 420/436 |

FOREIGN PATENT DOCUMENTS

FR 2.204.250 5/1974

OTHER PUBLICATIONS

ASTM Designation: G 31–72, Standard Practice for Laboratory Immersion Corrosion Testing of Metals, 1972.

ASTM Designation: G133–95, Standard Test Method for Linearly Reciprocating Ball–on–Flat Sliding Wear, 1995.

ASTM Designation: E23–96, Standard Test Methods for Notched Bar Impact Testing of Metallic Materials, 1996.

Schmidt, R. D. and Ferriss, D.P., "New Materials Resistant To Wear and Corrosion To 1000° C.", Wear, 1975, pp. 279–289, vol. 32, No. 3, Elsevier Sequoia S.A., Lausanne.

Raghu, Damodaran, and Wu, James B. C., "Recent Developments in Wear– and Corrosion–Resistant Alloys for the Oil Industry", Materials Performance, 1997, pp. 27–36, vol. 36, No. 11.

* cited by examiner

*Primary Examiner*—John P Sheehan

(74) *Attorney, Agent, or Firm*—Senniger, Powers, Leavitt & Roedel

(57) ABSTRACT

A Co-based alloy comprising 13–16 wt % Cr, 20–30 wt % Mo, 2.2–3.2 wt % Si, and balance Co, with a Cr:Si ratio of between about 4.5 and about 7.5, a Mo:Si ratio of between about 9 and about 15, wear resistance, and corrosion resistance in both oxidizing and reducing acids.

32 Claims, 5 Drawing Sheets

WEAR-RESISTANT, CORROSION-RESISTANT COBALT-BASED ALLOYS

CROSS REFERENCE TO RELATED APPLICATIONS

This is a continuation-in-part of application Ser. No. 10/356,952 filed Feb. 3, 2003, now abandoned and claims priority from provisional application Ser. No. 60/396,524 filed on Jul. 17, 2002.

BACKGROUND OF THE INVENTION

This invention is directed to alloys for use in industrial applications where resistance to wear and corrosion are required. Examples of such applications include build up material to be applied to components such as valves by plasma transfer arc welding. Other examples include cast turbocharger parts and welding on areas subject to wear on gas turbine blades in jet engines.

Certain alloys in commercial use for wear and corrosion applications are distributed by Deloro Stellite Company, Inc. under the trade designation Tribaloy. Alloys within the Tribaloy alloy family are disclosed in U.S. Pat. Nos. 3,410,732, 3,795,430, and 3,839,024. Two specific alloys in the Tribaloy family are distributed under the trade designations T-400 and T-800. The nominal composition of T-400 is Cr-8.5%, Mo-28%, Si-2.6%, and balance Co. The nominal composition of T-800 is Cr-17%, Mo-28%, Si-3.25%, and balance Co.

SUMMARY OF THE INVENTION

Among the objects of this invention are to provide an alloy for wear and corrosion applications which has enhanced oxidation resistance, to provide an alloy for wear and corrosion applications which has enhanced ductility, to provide an alloy for wear and corrosion applications which has enhanced impact resistance, and to provide an alloy for wear and corrosion applications which has enhanced corrosion resistance in both reducing and oxidizing acids.

Briefly, therefore, the invention is directed to a Co-based alloy comprising 13–16 wt % Cr, 20–30 wt % Mo, 2.2–3.2 wt % Si, and balance Co, with a Cr:Si ratio of between about 4.5 and about 7.5, a Mo:Si ratio of between about 9 and about 15, wear resistance, and corrosion resistance in both oxidizing and reducing acids.

Other objects and features of the invention will be in part apparent and in part pointed out hereinafter.

DETAILED DESCRIPTION OF THE INVENTION

Chromium is provided in the alloys of the invention to enhance corrosion resistance. The Cr content is preferably in the range of 13% to 16%. All percentages herein are by weight. One preferred embodiment employs about 14% Cr.

Molybdenum is provided in the alloys of the invention to impart wear resistance. The Mo content is preferably in the range of 20% to 30%. One preferred embodiment employs about 26% Mo.

Silicon is provided in the alloys of the invention to impart wear resistance in combination with Mo. The Si content is preferably in the range of 2.2% to 3.2%. One preferred embodiment employs about 2.6% Si.

The Cr and Si contents are selected such that the ratio of Cr:Si in the alloy is above about 4.5. In one preferred embodiment it is between 4.5 and 7.5. In one especially preferred embodiment this ratio is about 5.4. It has been discovered that this ratio is important to achieving enhanced oxidation resistance.

The Mo and Si contents are selected such that the ratio of Mo:Si in the alloy is above about 9. In one preferred embodiment it is between 9 and 15. In one especially preferred embodiment this ratio is about 10.8. It has been discovered that this ratio is important to achieving enhanced ductility.

Cobalt is provided in the alloys as the alloy matrix. Cobalt is selected because it can be alloyed with the elements Cr, Mo, and Si and tends to form a tough matrix. Cobalt is selected over Ni, Fe, combinations thereof, and combinations thereof with Co because it has been discovered that a matrix which consists essentially of Co is tougher and less brittle than a matrix which contains some Ni and/or Fe. The Co content is preferably in the range of 48 to 62%. One preferred embodiment employs about 54% Co.

Certain trace elements are present in the alloys of the invention due to the presence of such elements in scrap and otherwise due to the manufacturing process. These elements are not intentionally added, are tolerable. Carbon may be present up to about 1%. Boron may be present up to about 1%. Nickel may be present up to about 3%. Iron may be present up to about 3%. While the combination of these element tolerances is up to 8%, in a preferred embodiment the total trace element content is no more than 2%.

In a further aspect of the invention present in certain embodiments, the alloy is Mn-free, Cu-free, and free of all alloying elements having a material effect on metallurgical properties other than Cr, Mo, and Si in the Co matrix.

Figure 1:
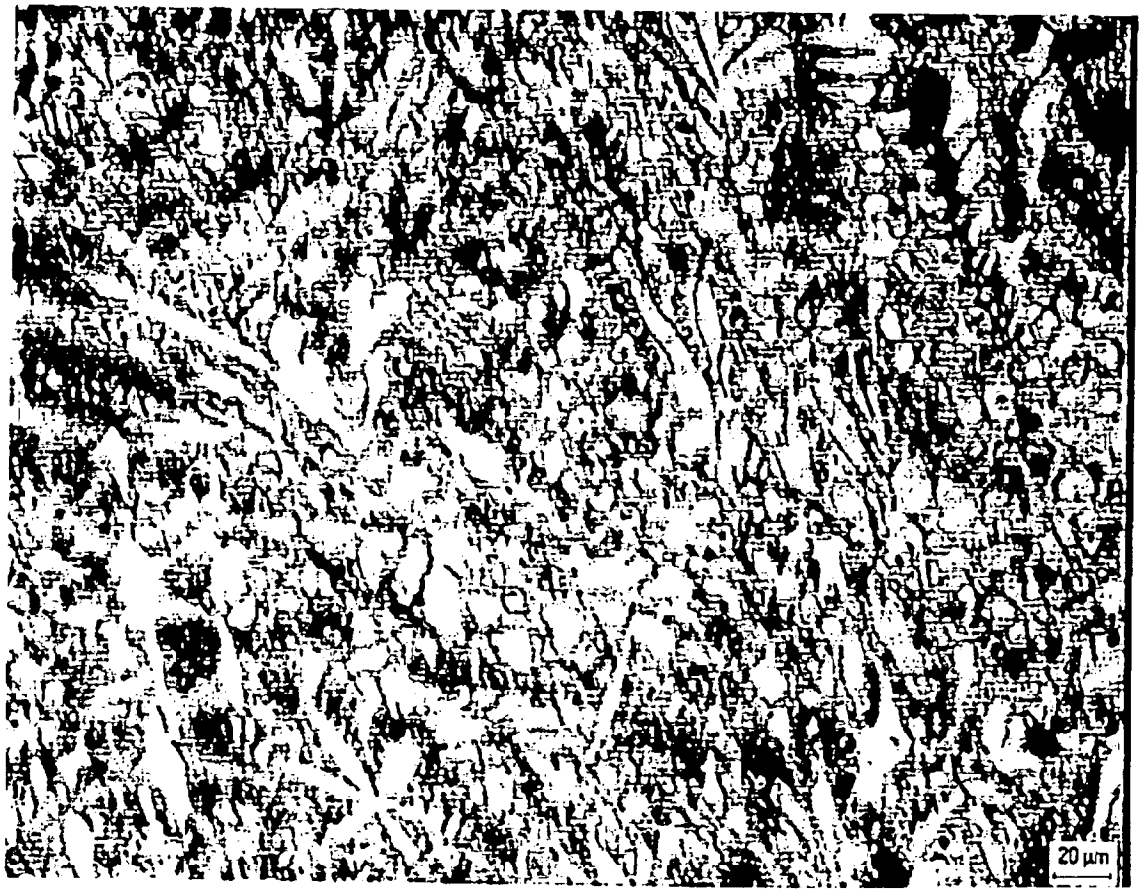
FIG. 1 is a photomicrograph illustrating the microstructure of the invention.

In one aspect the microstructure of the invention typically consists of 40–55% by volume Laves phase, depending on the chemical composition and cooling rate. The microstructure of an undiluted weld deposit made by plasma transferred arc welding deposition is presented in FIG. 1. In one preferred aspect of the invention, the Cr/Si ratio is between about 1.04 and about 1.36 in the Laves phase and between about 9.6 and 10.8 in the matrix. In contrast, the Cr/Si ratio in alloy T-400 is between about 0.73 and about 0.86 in the Laves phase and between about 5.95 and about 6.85 in the matrix. This is in contrast to the Mo/Si ratios of the respective alloys, which are similar to each other. This greater Cr/Si ratio in the Laves phase and in the matrix is believed to be responsible for an enhancement in oxidation resistance. The similar Mo/Si ratios are indicative of analogous wear resistance.

The alloys of the invention have improved physical properties which render them especially suitable for certain wear and corrosion applications. In one preferred embodiment, the oxidation resistance is such that weight % gain measured by thermal gravitational analysis after 200 minutes at 760 C is less than 0.5%. The alloys show substantially no surface defects upon casting. Plasma transfer arc welding deposits are substantially smooth.

In another aspect the alloys demonstrate corrosion resistance in reducing acid $H_2SO_4$ characterized by less than about 50 mils/year (1.3 mm/year) thickness loss when tested according to ASTM specification G31–72 in a 10% solution at 102 C. In another aspect the alloys demonstrate corrosion resistance in oxidizing acid $HNO_3$ characterized by less than about 300 mils/year (7.6 mm/year) thickness loss when tested according to ASTM specification G31–72 in a 65% solution at 66 C. In another aspect the alloys demonstrate corrosion resistance in reducing acid HCl characterized by less than about 4 mils/year (0.1 mm/year) thickness loss when tested according to ASTM specification G31–72 in a 5% solution at 66 C.

In another aspect the alloys demonstrate impact strength of at least about 2.0 Joules when evaluated by an un-notched Charpy impact test according to ASTM specification E23–96. And in one aspect the alloys have excellent high-temperature metal-to-metal wear properties. These are demonstrated in that the alloys have a volume loss of less than about 0.06 cubic millimeters when tested according to the well known Cameron-Plint test of ASTM G133-95 at 482 C with alloy cylinders in metal-to-metal wear contact with nitrided 310 stainless steel flat plates. And the 310 stainless volume loss is on the order of 0.4 cubic millimeters or less.

The alloys of the invention are provided in the form of powder for deposition by plasma transfer arc welding deposition, laser cladding, plasma spraying, and high velocity oxyfuel spraying. The alloys can also be provided in the form of welding rods, wires, and electrodes for deposition by gas tungsten arc welding, shielded metal arc welding, or gas metal arc welding. The alloys are also provided in the form of castings and powder metallurgical components.

Certain aspects of the invention are further illustrated in the following examples.

EXAMPLE 1

The oxidation resistance of an alloy of the invention (T-400C) was evaluated in comparison to the oxidation resistance of prior art alloys T-400 and T-800. The compositions of the respective alloys were as follows:

| | Cr | Mo | Si | Cr:Si | Mo:Si |
|---|---|---|---|---|---|
| 0C | 14 | 26 | 2.6 | 5.4 | 10 |
| 0 | 8.5 | 28 | 2.6 | 3.3 | 10.8 |
| 0 | 17 | 28 | 3.25 | 5.2 | 8.6 |

Figure 2:
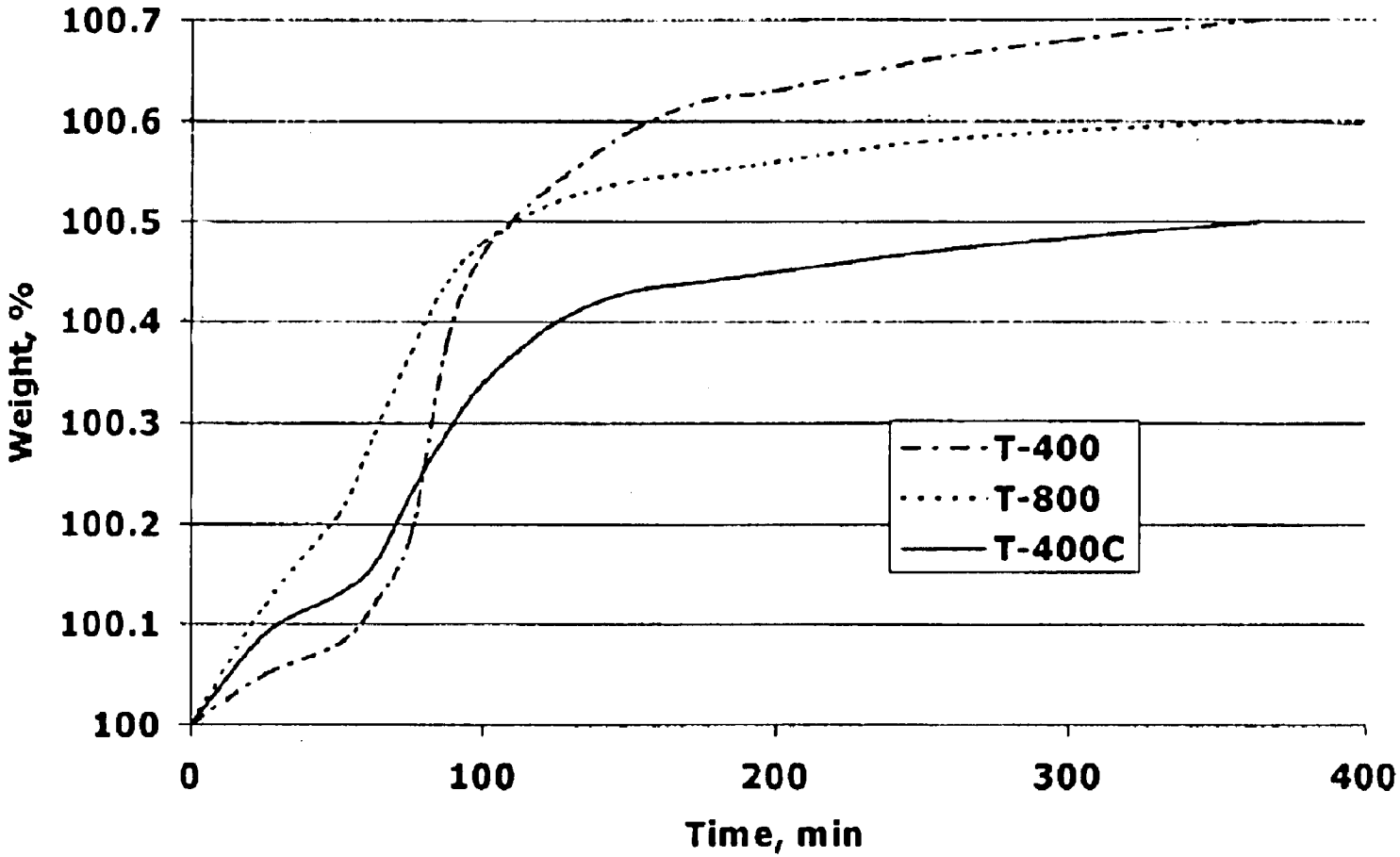
FIG. 2 is graphical presentation of thermal gravitational analysis data comparing the invention to prior art.

Thermal gravitational analysis (TGA) was performed at 760 C. The results are presented in FIG. 2. These results show that the least weight gain, and therefore least oxidation, corresponded to the alloy of the invention T-400C. In particular, the weight % gain of the alloy of the invention measured by thermal gravitational analysis after 200 minutes at 760 C is less than 0.5%. Enhanced resistance to oxidation is critical where the alloys are for use in the forms of castings and weld overlays, because excessive oxidation can result in casting and welding defects. And in high temperature applications where there is substantial metal-to-metal contact, excessive oxidation can result in sticking of moving parts.

EXAMPLE 2

An un-notched Charpy impact test according to ASTM specification E23–96 was conducted on each of the alloys of Example 1. The impact strength of the T-800 alloy was determined to be 1.36 Joules. The impact strength of the T-400 alloy was determined to be 2.72 Joules. The alloy of the invention demonstrates impact strength of at least about 2.0 Joules. In particular, the impact strength of the T-400C alloy was determined to be 2.72 Joules. Enhanced impact strength, or ductility, is critical in certain applications to prevent cracking upon casting, weld overlaying, or in service.

EXAMPLE 3

Figure 3:
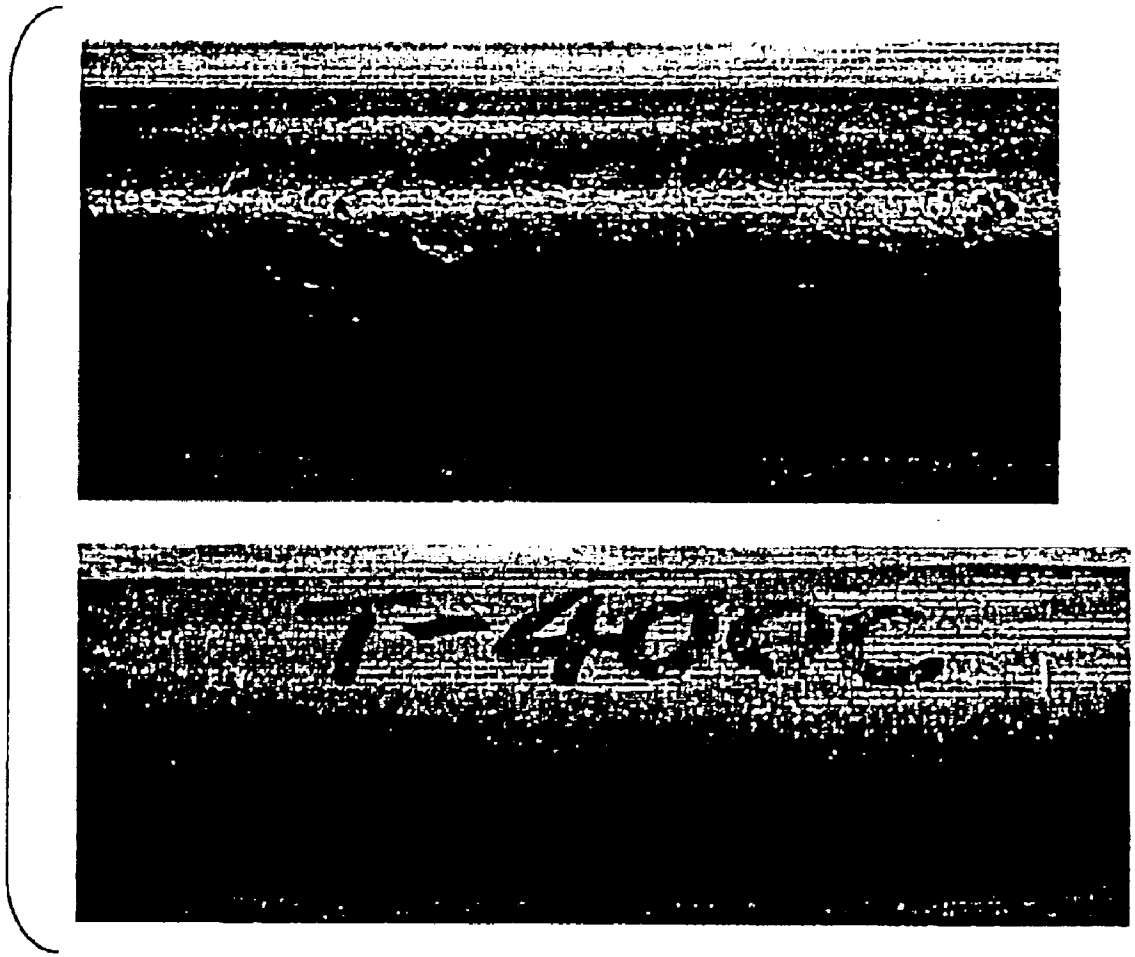
FIG. 3 is photograph comparing a cast surface of the invention to a cast surface of a prior art alloy.

One-inch diameter bars were cast from the T-400 and T-400C alloys of Example 1 to evaluate their casting surface finish and suitability for precision casting. Photographs thereof are presented in FIG. 3. These photographs illustrate the absence of oxidation surface defects on the T-400C bar. The absence of oxidation surface defects is critical in precision casting applications because it minimizes the amount of machining required and raises production yields, as less material must be removed to yield suitable surface characteristics.

EXAMPLE 4

Figure 4:
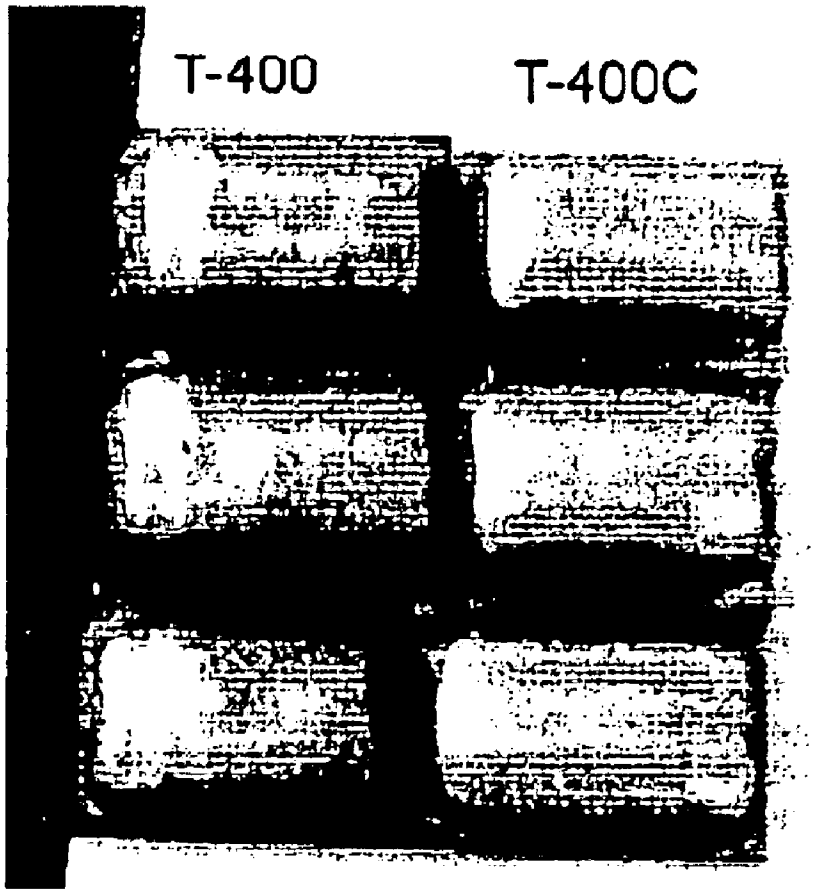
FIG. 4 is a photograph comparing the alloy of the invention deposited by plasma transfer arc welding to a prior art alloy deposited by plasma transfer arc welding.

Alloys T-400 and T-400C of Example 1 were tested by deposition by plasma transfer arc welding deposition (PTA) for deposit quality. A comparison of the deposit quality is illustrated in FIG. 4, which shows that the T-400C deposit had a substantially smoother surface. This demonstrates that the T-400C is especially suited for an application such as a wear-resistant overlay on a diesel engine valve. The improved flowability of the T-400C results in a smoother deposit, such that less material has to be removed by machining to create a flat surface. The amount of required machining is also kept low because there is less oxidation which has to be removed. Accordingly, the amount of material which is removed and scrapped is reduced. The main contribution in the improved flowability of the T-400C is its high Cr content. Cr promotes formation of a thin, impervious oxide film, which prevents further oxidation. A molten puddle with a thin oxide film generally has better flowability than otherwise.

EXAMPLE 5

Alloys T-400C and T-400 of Example 1 were tested under the procedures of ASTM G31–72 for resistance to corrosion in reducing acids such as hydrochloric acid and dilute sulfuric acid, as well as in oxidizing acids such as nitric acid. The results were as follows:

| Condition | T-400C* | T-400* |
|---|---|---|
| 10%, 102 C. | 27 mils (0.7 mm) | 180 mils (4.6 mm) |
| 65%, 66 C. | 195 mils (5 mm) | 780 mils (19.8 mm) |
| 5%, 66 C. | 3.4 mils (0.09 mm) | 5.1 mils (0.13 mm) |

Calculated thickness loss in mils/year (1 mil = .001 inch)

These results underscore that the combination of elemental components and elemental ratios imparts enhanced corrosion resistance in both reducing and oxidizing acids. In particular, the alloys demonstrate corrosion resistance in reducing acid $H_2SO_4$ characterized by less than about 50 mils/year (1.3 mm/year) thickness loss when tested according to ASTM specification G31–72 in a 10% solution at 102 C. The alloys also demonstrate corrosion resistance in oxidizing acid $HNO_3$ characterized by less than about 300 mils/year (7.6 mm/year) thickness loss when tested according to ASTM specification G31–72 in a 65% solution at 66 C. And in another aspect the alloys demonstrate corrosion resistance in reducing acid HCl characterized by less than about 4 mils/year (0.1 mm/year) thickness loss when tested according to ASTM specification G31–72 in a 5% solution at 66 C.

EXAMPLE 6

Figure 5:
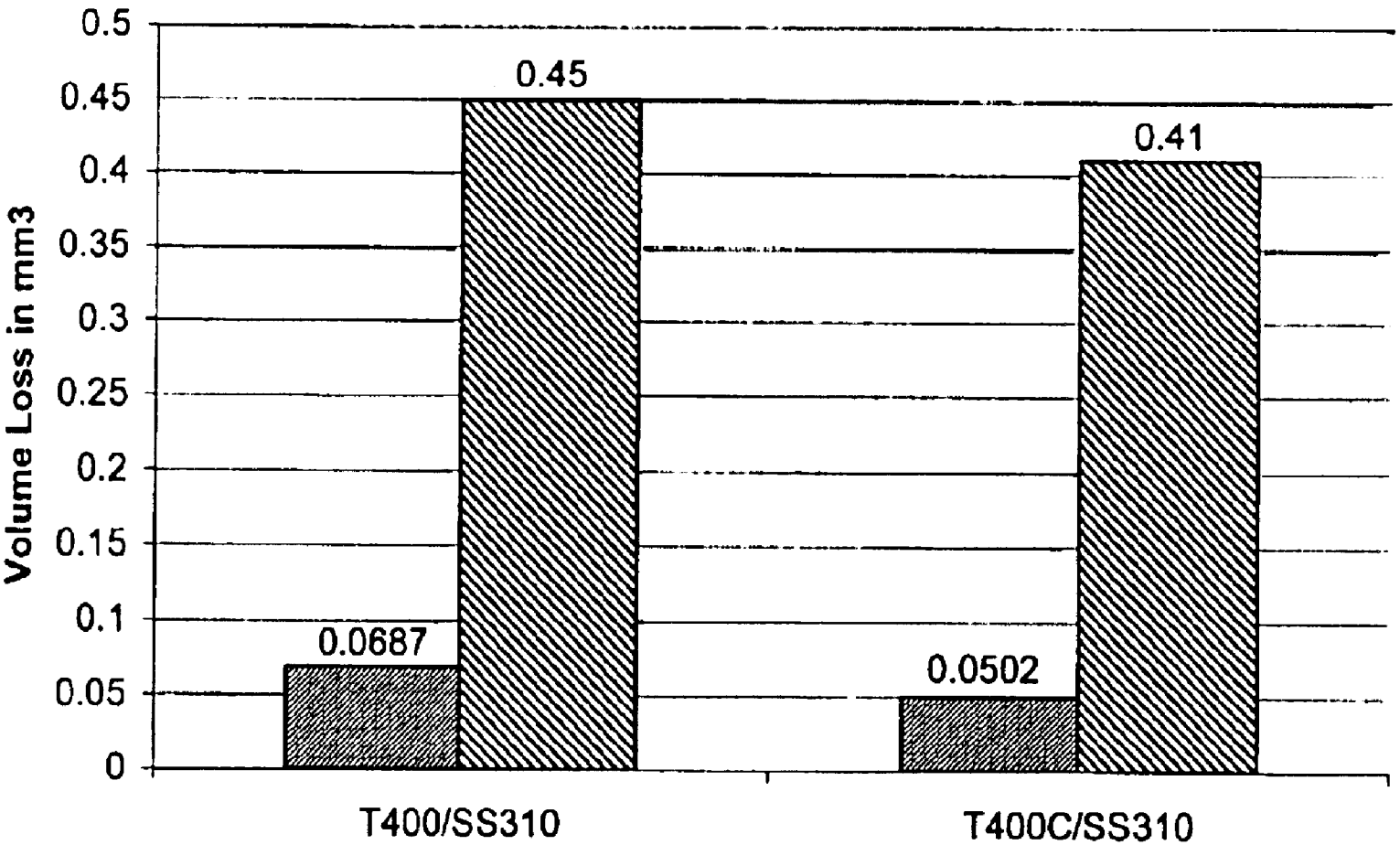
FIG. 5 is a graphical presentation comparing wear data of the alloy of the invention to wear data of a prior art alloy.

Alloys T-400C and T-400 of Example 1 were tested under a high-temperature wear test well known in the art as the Cameron-Plint test according to ASTM G133-95. The test was carried out at 482 C with alloy cylinders in metal-to-metal wear contact with nitrided 310 stainless steel flat plates. The results are presented in FIG. 5. These show that the T-400C suffered less wear than the T-400 and that the T-400C caused less wear in the stainless steel plate. These results demonstrate excellent metal-to-metal wear resistance evidenced by a volume loss of less than about 0.06 cubic millimeters when tested according to ASTM G133-95 at 482 C with alloy cylinders in metal-to-metal metal Wear contact with nitrided 310 stainless steel flat plates. And the 310 stainless volume loss is on the order of 0.4 cubic millimeters or less.

As various changes could be made in the above embodiments without departing from the scope of the invention, it is intended that all matter contained in the above description shall be interpreted as illustrative and not in a limiting sense.

What is claimed is:

1. A Co-based alloy comprising:

13–16 wt % Cr,

20–30 wt % Mo, 2.2–3.2 wt % Si, and balance Co;

the alloy having a Cr:Si ratio of between about 4.5 and about 7.5, a Mo:Si ratio of between about 9 and about 15, wear resistance, and resistance to both oxidizing and reducing corrosion.

2. The alloy of claim consisting essentially of

13–16 wt % Cr,

20–30 wt % Mo, 2.2–3.2 wt % Si, and

48–62 wt % Co.

3. The alloy of claim 1 having corrosion resistance in reducing acid $H_2SO_4$ characterized by less than about 50 mils/year (1.3 mm/year) thickness loss when tested according to ASTM specification G31–72 in a 10% solution at 102° C.

4. The alloy of claim 1 having corrosion resistance in oxidizing acid $HNO_3$ characterized by less than about 300 mils/year (7.6 mm/year) thickness loss when tested according to ASTM specification G31–72 in a 65% solution at 66° C.

5. The alloy of claim 1 having corrosion resistance in reducing acid HCl characterized by less than about 4 mils/year (0.1 mm/year) thickness loss when tested according to ASTM specification G31–72 in a 5% solution at 66° C.

6. The alloy of claim 1 having impact strength of at least about 2.0 Joules when evaluated by an un-notched Charpy impact test according to ASTM specification E23–96.

7. The alloy of claim 1 having a metal-to-metal wear resistance characterized by a volume loss of less than about 0.06 cubic millimeters when tested according to ASTM G133–95 at 482 C with alloy cylinders in metal-to-metal wear contact with nitrided 310 stainless steel flat plates.

8. The alloy of claim 2 having corrosion resistance in reducing acid $H_2SO_4$ characterized by less than about 50 mils/year (1.3 mm/year) thickness loss when tested according to ASTM specification G31–72 in a 10% solution at 102 C.

9. The alloy of claim 2 having corrosion resistance in oxidizing acid $HNO_3$ characterized by less than about 300 mils/year (7.6 mm/year) thickness loss when tested according to ASTM specification G31–72 in a 65% solution at 66 C.

10. The alloy of claim 2 having corrosion resistance in reducing acid HCl characterized by less than about 4 mils/year (0.1 mm/year) thickness loss when tested according to ASTM specification G31–72 in a 5% solution at 66 C.

11. The alloy of claim 2 having impact strength of at least about 2.0 Joules when evaluated by an un-notched Charpy impact test according to ASTM specification E23–96.

12. The alloy of claim 1 comprising about 14 wt % Cr.

13. The alloy of claim 1 comprising about 26 wt % Mo.

14. The alloy of claim 1 comprising about 2.6 wt % Si.

15. The alloy of claim 1 having a Cr:Si ratio of about 5.4.

16. The alloy of claim 1 having a Mo:Si ratio of about 10.8.

17. The alloy of claim 1 consisting essentially of

13–16 wt % Cr,

20–30 wt % Mo, 2.2–3.2 wt % Si, and

48–62 wt % Co;

wherein the alloy is Mn-free, Cu-free, and free of all alloying elements having a material effect on metallurgical properties other than Cr, Mo, and Si;

wherein, the alloy has a total trace element content of no more than 2 wt %.

18. The alloy of claim 1 consisting essentially of

13–16 wt % Cr,

20–30 wt % Mo, 2.2–3.2 wt % Si, and

48–62 wt % Co;

wherein the alloy is Mn-free, Cu-free, and free of all alloying elements having a material effect on metallurgical properties other than Cr,Mo, and Si;

wherein the alloy has a total trace element content of no more than 2 wt %;

wherein the alloy has a Cr:Si ratio of between 4.5 and 7.5 and a Mo:Si ratio between 9 and 15.

19. The alloy of claim 18 having corrosion resistance in reducing acid $H_2SO_4$ characterized by less than about 50 mile/year (1.3 mm/year) thickness loss when tested according to ASTM specification G31–72 in a 10% solution at 102 C.

20. The alloy of claim 18 having corrosion resistance in oxidizing acid $HNO_3$ characterized by less than about 300 mile/year (7.6 mm/year) thickness loss when tested according to ASTM specification G31–72 in a 65% solution at 66 C.

21. The alloy of claim 18 having corrosion resistance in reducing acid HCl characterized by less than about 4 mils/year (0.1 mm/year) thickness loss when tested according to ASTM specification G31–72 in a 5% solution at 66 C.

22. The alloy of claim 1 having a microstructure of about 40–55% by volume Laves phase.

23. The alloy of claim 1 having a microstructure of about 40–55% by volume Laves phase and a Laves phase Cr:Si ratio between about 1.04 and about 1.36.

24. The alloy of claim 1 consisting essentially of:

13–16 wt % Cr,

20–30 wt % Mo, 2.2–3.2 wt % Si, and

48–62 wt % Co;

wherein the alloy is Mn-free, Cu-free, and free of all alloying elements having a material effect on metallurgical properties other than Cr, Mo, and Si;

wherein the alloy has a total trace element content of no more than 2 wt %;

wherein the alloy has a Cr:Si ratio of between 4.5 and 7.5 and a Mo:Si ratio between 9 and 15;

wherein the alloy demonstrates corrosion resistance in reducing acid $H_2SO_4$ characterized by less than about 50 mils/year (1.3 mm/year) thickness loss when tested according to ASTM specification G31–72 in a 10% solution at 102 C, corrosion resistance in oxidizing acid $HNO_3$ characterized by less than about 300 mils/year (7.6 mm/year) thickness loss when tested according to ASTM specification G31–72 in a 65% solution at 66 C, and corrosion resistance in reducing acid HCl characterized by less than about 4 mils/year (0.1 mm/year) thickness loss when tested according to ASTM specification G31–72 in a 5% solution at 66 C.

25. The alloy of claim 1 consisting essentially of, by approximate wt %:

14 Cr,

26 Mo, 2.6 Si, and

48–62 wt % Co;

wherein the alloy is Mn-free, Cu-free, and free of all alloying elements having a material effect on metallurgical properties other than Cr, Mo, and Si; and wherein the alloy has a total trace element content of no more than 2 wt %.

26. A Co-based alloy consisting essentially of:

13–16 wt % Cr,

20–30 wt % Mo, 2.2–3.2 wt % Si, and

48–62 wt % Co;

wherein the alloy is Mn-free; Cu-free; free of all alloying elements having a material effect on metallurgical properties other than Cr, Mo, and Si; and has a total trace element content of no more than about 2 wt %;

wherein the alloy has a Cr:Si ratio of between 4.5 and 7.5 and a Mo:Si ratio between 9 and 15;

wherein the alloy demonstrates corrosion resistance in reducing acid $H_2SO_{04}$ characterized by less than about 50 mils/year (1.3 mm/year) thickness loss when tested according to ASTM specification G31–72 in a 10% solution at 102 C, corrosion resistance in oxidizing acid $HNO_3$ characterized by less than about 300 mils/year (7.6 mm/year) thickness loss when tested according to ASTM specification G31–72 in a 65% solution at 66 C, corrosion resistance in reducing acid HCl characterized by less than about 4 mils/year (0.1 mm/year) thickness loss when tested according to ASTM specification G31–72 in a 5% solution at 66 C, and impact strength of at least about 2.0 Joules when evaluated by an un-notched Charpy impact test according to ASTM specification E23–96; and wherein the alloy has a microstructure comprising about 40–55% by volume Laves phase.

27. The alloy of claim 1 being in powder form suitable for deposition by plasma transferred arc welding deposition, laser cladding, plasma spraying, or high velocity oxyfuel spraying.

28. The alloy of claim 1 being in the form of welding rods.

29. The alloy of claim 1 being in the form of wires.

30. The alloy of claim 1 being in the form of electrodes.

31. The alloy of claim 1 being in the form of a casting.

32. The alloy of claim 1 being in the form of powder metallurgical components.

* * * * *

UNITED STATES PATENT AND TRADEMARK OFFICE

CERTIFICATE OF CORRECTION

PATENT NO. : 6,852,176 B2
DATED : February 8, 2005
INVENTOR(S) : Wu et al.

It is certified that error appears in the above-identified patent and that said Letters Patent is hereby corrected as shown below:

Column 5,
Line 32, "claim consisting" should read -- claim 1 consisting --.

Column 6,
Lines 39 and 44, "mile/year" should read -- mils/year --.

Column 8,
Line 6, "$H_2SO_{04}$" should read -- $H_2SO_4$ --.

Signed and Sealed this

Seventeenth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,852,176 B2
APPLICATION NO. : 10/250205
DATED : February 8, 2005
INVENTOR(S) : James B. C. Wu et al.

It is certified that error appears in the above-identified patent and that said Letters Patent is hereby corrected as shown below:

Column 4, lines 47-49 should read

| --Media | Condition | T - 400C* | T - 400* |
|---|---|---|---|
| $H_2SO_4$ | 10%, 102 C | 27 mils (0.7 mm) | 180 mils (4.6 mm) |
| $HNO_3$ | 65%, 66 C | 195 mils (5 mm) | 780 mils (19.8 mm) |
| HCl | 5%, 66 C | 3.4 mils (0.09 mm) | 5.1 mils (0.13 mm) |

*calculated thickness loss in mils/year (1 mil = .001 inch) --.

(Application page 9, lines 1-5)

Column 5, line 13, "metal-to-metal metal Wear contact" should read --metal-to metal wear contact--.

Signed and Sealed this

Twenty-fourth Day of October, 2006

JON W. DUDAS
*Director of the United States Patent and Trademark Office*